US011218809B2

(12) United States Patent
Ramones et al.

(10) Patent No.: US 11,218,809 B2
(45) Date of Patent: Jan. 4, 2022

(54) SPEAKER INTEGRATED ELECTRONIC DEVICE WITH SPEAKER DRIVEN PASSIVE COOLING

(71) Applicant: Netgear, Inc., San Jose, CA (US)

(72) Inventors: John Kui Yin Ramones, San Ramon, CA (US); Aron Han, San Jose, CA (US); Eduardo Hernandez Pacheco, Sunnyvale, CA (US)

(73) Assignee: Netgear, Inc., San Jose, CA (US)

( * ) Notice: Subject to any disclaimer, the term of this patent is extended or adjusted under 35 U.S.C. 154(b) by 0 days.

(21) Appl. No.: 16/152,653

(22) Filed: Oct. 5, 2018

(65) Prior Publication Data

US 2020/0112792 A1 Apr. 9, 2020

(51) Int. Cl.

| | |
|---|---|
| ***H04R 9/02*** | (2006.01) |
| ***H04R 1/28*** | (2006.01) |
| ***H04R 1/02*** | (2006.01) |
| ***H04R 9/06*** | (2006.01) |
| ***H04R 7/16*** | (2006.01) |
| ***H04R 9/04*** | (2006.01) |
| ***H04R 31/00*** | (2006.01) |

(52) U.S. Cl.

CPC ..... *H04R 9/022* (2013.01); *H04R 1/02* (2013.01); *H04R 1/2834* (2013.01); *H04R 7/16* (2013.01); *H04R 9/046* (2013.01); *H04R 9/06* (2013.01); *H04R 31/006* (2013.01); *H04R 2209/041* (2013.01)

(58) Field of Classification Search

CPC ..... H04R 2420/07; H04R 1/025; H04R 1/02; H04R 2201/028; H04R 1/26; H04R 1/2834; H04R 9/022; H04R 1/023; H04R 1/345; H04R 1/24; H04R 1/323; H04R 1/403; H04R 2201/025; H04R 27/00; H04R 5/02; H04R 1/028; H04R 1/2819; H04R 1/2896; G06F 1/20; H05K 7/2049

USPC ..... 381/87, 334, 397, 189, 338, 336, 349, 381/430; 181/144, 156, 153, 151, 199, 181/165

See application file for complete search history.

(56) References Cited

U.S. PATENT DOCUMENTS

| | | | |
|---|---|---|---|
| 4,625,328 | A | 11/1986 | Freadman |
| 5,042,072 | A | 8/1991 | Button |
| 5,357,586 | A | 10/1994 | Nordschow et al. |
| 5,940,522 | A | 8/1999 | Cahill et al. |
| 6,259,798 | B1 | 7/2001 | Perkins et al. |

(Continued)

*Primary Examiner* — Alexander Krzystan
*Assistant Examiner* — Julie X Dang
(74) *Attorney, Agent, or Firm* — Boyle Fredrickson S.C.

(57) ABSTRACT

A passive cooling device is disclosed for use with a speaker integrated electronic device. Also disclosed is a method of using the device for generating passive cooling and increasing the sound output by the speaker integrated electronic device when outputting low frequency sound. The electronic device has an internal housing in which the speaker is located with a diaphragm extending through a void in the housing wall. The internal housing also has an air flow channel in fluid communication with the housing interior and an outlet adjacent an electronic component. Movement of the diaphragm directs moving air through the channel to reduce the operating temperature of the electronic component during speaker activation, while air movement in the internal housing increase the sound output by the speaker integrated electronic device.

20 Claims, 12 Drawing Sheets

(56) References Cited

U.S. PATENT DOCUMENTS

| | | | | |
|---|---|---|---|---|
| 6,567,529 | B1 | 5/2003 | Roark | |
| 7,715,584 | B2 | 5/2010 | Proni | |
| 8,259,969 | B2 | 9/2012 | Xi | |
| 9,571,935 | B2 | 2/2017 | Moro | |
| 10,104,761 | B1 * | 10/2018 | MacDonald | H04R 27/00 |
| 2003/0053644 | A1 * | 3/2003 | Vandersteen | H04R 1/26<br>381/182 |
| 2006/0239844 | A1 * | 10/2006 | Nakayama | H01L 23/467<br>417/413.2 |
| 2008/0056528 | A1 | 3/2008 | Yano et al. | |
| 2013/0197914 | A1 * | 8/2013 | Yelvington | G06F 3/167<br>704/275 |
| 2014/0362522 | A1 * | 12/2014 | Degner | G06F 1/20<br>361/679.47 |
| 2017/0346650 | A1 * | 11/2017 | Eom | H05K 5/0004 |
| 2018/0376240 | A1 * | 12/2018 | Brousseau | H04R 27/00 |
| 2018/0376265 | A1 * | 12/2018 | Warden | H04R 27/00 |
| 2019/0069077 | A1 * | 2/2019 | Sullivan | H04R 1/24 |
| 2019/0104367 | A1 * | 4/2019 | Xu | H04R 1/028 |

* cited by examiner

SPEAKER INTEGRATED ELECTRONIC DEVICE WITH SPEAKER DRIVEN PASSIVE COOLING

BACKGROUND OF THE INVENTION

1. Field of the Invention

The invention relates generally to a speaker chamber for sound amplification and passive cooling of an electronic device, and more particularly, relates to an electronic device containing a resonance chamber for sound amplification that includes a channel for passive cooling of the electronic device via speaker driven airflow. The invention additionally relates to a method of using the same.

2. Discussion of the Related Art

Recently, the market for smaller table top speakers, and internet connect speakers, and smart speakers with integrated voice-activated virtual assistants has continued to expand. Common among many of these electronic devices is the need to maintain a relatively small form factor, which allows to the electronic device to be placed on a desk, table or countertop without occupying excessively large areas. In addition to maintaining a relatively small form factor, customers also desire such speaker integrated small electronic devices to produce high quality audio output. However, size constraints often limit both the number of speakers and the size of the speakers that can be placed within such small electronic devices. This is of particular concern for generating low-end audio frequencies, e.g., bass, which are often created through the use of a woofer style speaker that has a relatively larger diameter speaker diaphragm, that may not be well suited for use in smaller electronic devices.

Furthermore, when multiple speakers are located in a small electronic device, such a table top speaker, limited space within the electronic device may result in decreased air flow and elevated temperatures during operation. This overheating is only exacerbated in the context of smart speakers that include additional heat generating computer components within the housing of the small electronic device.

Accordingly, while the inclusion of more speakers and/or larger speakers into a small electronic device may appear to be one viable solution to improving audio quality, it may result in undesirable overheating within the component. Such overheating may adversely affect product performance, such that simply adding more and/or larger speakers to a small electronic device may not be the optimal solution to improving audio quality and providing temperature control.

Nonetheless, there remains a need and desire to allow for improvements to the audio quality generated by such relatively small speakers; and, in the case of smart speakers with additional heat generating electronic components, there remains a need and desire to allow for improvements to the audio quality and cooling of the small electronic device.

In light of the foregoing, an audio generating electronic device with an integrated speaker manifold, which includes both an amplification chamber for low end frequency emitted by the electronic device and a duct for passive cooling of an electronic device component vis speaker driven airflow from the amplification chamber, is desired.

Also, a method of using a speaker manifold that exhibits both low frequency audio enhancement and internal electrical component cooling is also desired.

SUMMARY OF THE INVENTION

One or more of the above-identified needs are met by a passively cooled speaker integrated electronic device including a casing defining an interior with a housing disposed within the interior of the casing. The housing has an outer wall defining a housing interior. A speaker is at received within the housing interior and includes a diaphragm that extends through a void in the outer wall of the housing. An air flow channel extends from an inlet in fluid communication with the housing interior to an outlet in fluid communication with the interior of the casing. An electronic component located within the interior of the casing is configured to receive air flow from the outlet in response to movement of the diaphragm during speaker activation.

In one embodiment, the electronic component has a first operating temperature in the absence of speaker activation and a second operating temperature when receiving air flow from the outlet in response to movement of the diaphragm during speaker activation, that is between 1° and 6° Celsius less than the first operating temperature.

In one embodiment, the air flow at the outlet in response to movement of the diaphragm during speaker activation has a velocity of between 6 meters per second and 14 meters per second.

In one embodiment, the housing interior is a resonance chamber configured to increase a sound pressure level output of frequencies between 20 Hz and 250 Hz from the electronic device during speaker activation.

In one embodiment, the electronic device is a wireless router.

In one embodiment, the electronic device is a smart speaker including a voice-activated virtual assistant In accordance with another aspect of the invention, a passively cooled speaker integrated wireless router is provided including an outer housing defining an interior with an inner housing disposed within the interior of the outer housing. The inner housing has a wall defining a resonance chamber. At least one speaker is at received within the resonance chamber and includes a diaphragm that extends through at least one void in the wall of the inner housing. An air flow channel extends from an inlet in fluid communication with the resonance chamber to an outlet in fluid communication with the interior of the outer housing. A circuit board, including a wireless local area network circuit is located within the interior of the casing and is configured to receive air flow from the outlet in response to movement of the diaphragm during speaker activation.

In accordance with another aspect of the invention, a method of passively cooling a speaker integrated electronic device is provided, where the device comprises a casing having an interior, a housing disposed within the interior having an outer wall defining a housing interior, a speaker driver disposed within the housing interior having a diaphragm that extends outwardly from the driver through a void in the outer wall of the housing, an air flow channel extending from an inlet in fluid communication with the housing interior to an outlet in fluid communication with the interior of the casing, and an electronic component located within the interior of the casing. Subsequent actions include providing an electrical signal to the speaker driver to active the diaphragm, thereby moving the diaphragm to push air within housing interior and create an air flow and directing the air flow from the inlet to the outlet through the air flow chamber. The method further includes expelling the air flow from the outlet into the interior of the casing at a velocity of less than 14 meters per second; and decreasing an operating temperature of the electronic component between 1° and 6° Celsius upon receiving the air flow in the interior of the casing, as compared to an operating temperature in the absence of speaker driver activation.

In one embodiment, the method further includes reverberating the sound wave within the housing interior to generate a secondary output from the speaker integrated electronic device, wherein the secondary output has a sound pressure level output of between 1 to 10 dB when the frequency of the sound wave is between 20 Hz and 250 Hz.

These and other objects, advantages, and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings, in which like reference numerals represent like parts throughout, and in which.

DETAILED DESCRIPTION OF THE PREFERRED EMBODIMENTS

A wide variety of speaker integrated electronic devices could be used with a speaker manifold in accordance with the invention as defined by the claims. Hence, while the preferred embodiments of the invention will now be described with reference to mounting a smart speaker, it should be understood that the invention is in no way so limited.

Figure 1:
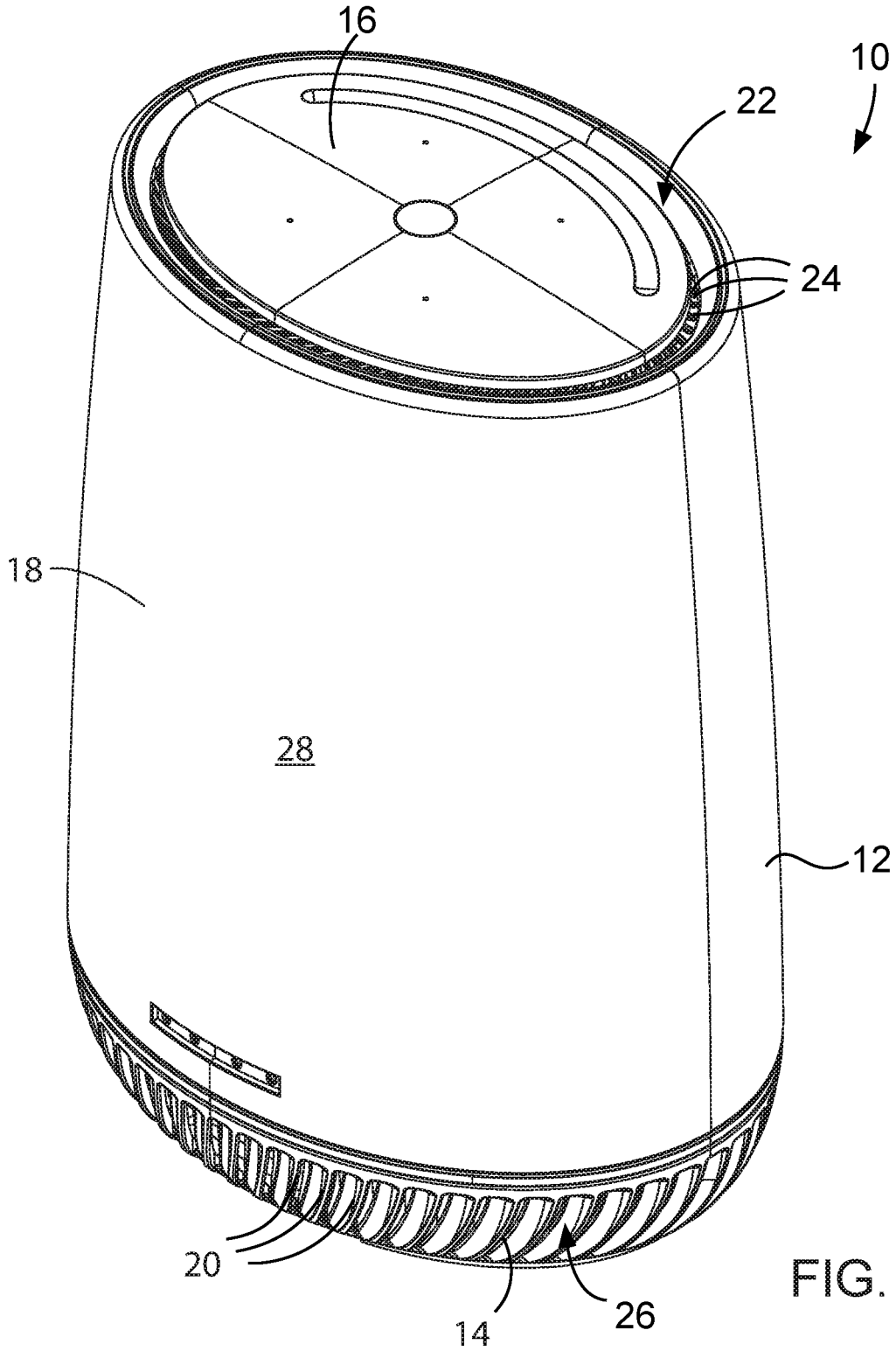
FIG. 1 is a front, upper and left-side isometric view of a speaker integrated electronic device constructed in accordance with an embodiment of the present invention.

FIG. 1 is an isometric view of a speaker integrated electronic device 10, i.e., electronic device, constructed in accordance with one embodiment of the present invention. As shown in FIG. 1, the electronic device 10 may be generally elliptically cylindrical in shape but is not limited to such a form. The electronic device 10 has a casing or outer housing 12, including a base 14, a top 16, and a sidewall 18 extending between the base 14 and top 16. As shown in FIG. 1, a series of slots 20 or vents may extend about the perimeter of and through the base 14 while a recessed channel 22 in the top 16 may include a series of perforations 24 or vents that extend through the top 16. Collectively, the slots 20 and perforations 24 allow air to flow through base 14 and top 16, respectively, and into the interior 26 of the housing 12. In one embodiment of the present invention, the sidewall 18, or a portion thereof may be formed of a porous material, such as a fabric 28 wrapped over a perforated rigid frame 30. The use of such a porous material perforated frame 30 may facilitate air flow through the interior 26 of the housing 12 and/or transmission of audio from the internal speakers 32, 34 as will be described in further detail below.

Figure 2:
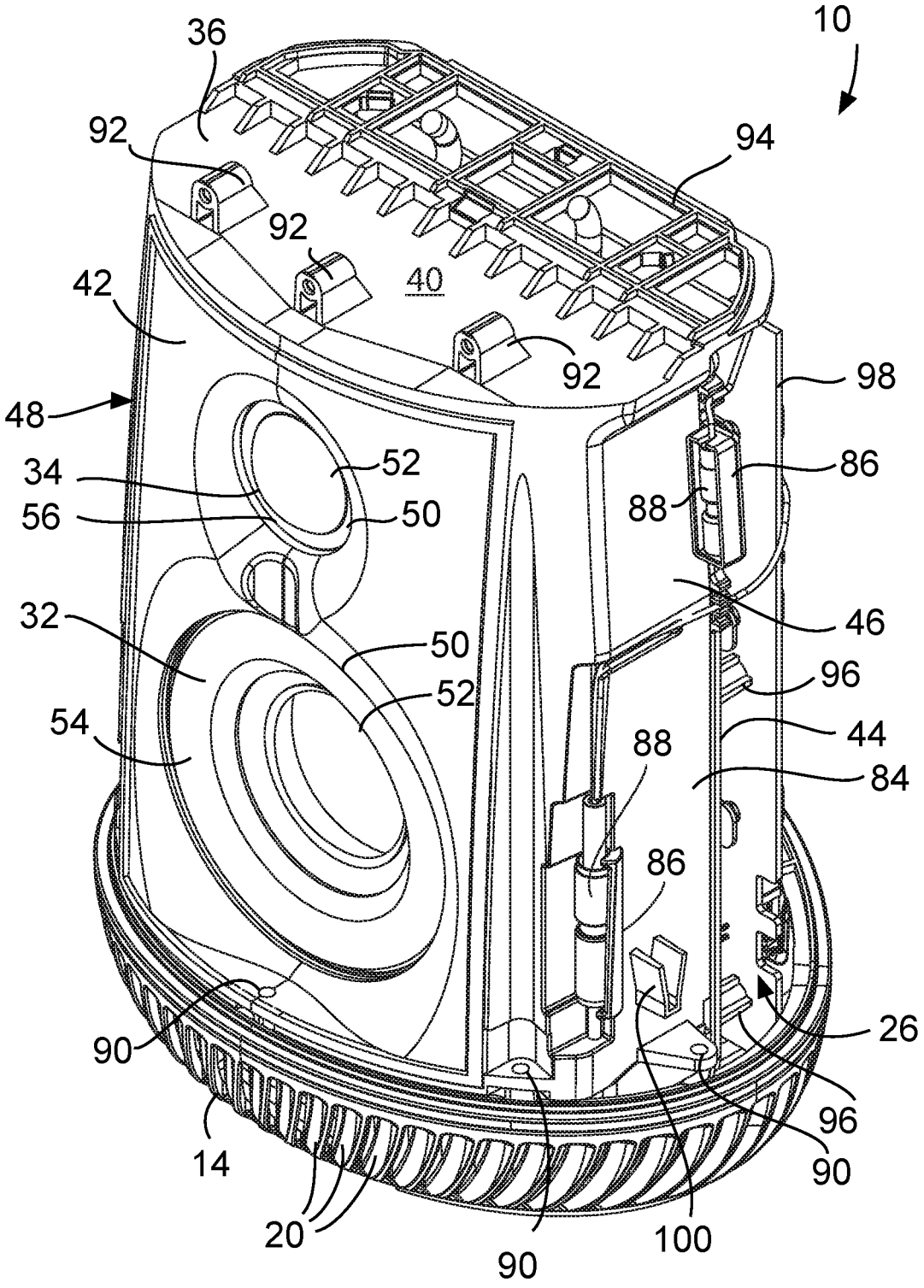
FIG. 2 is a front, upper and left-side isometric view of the speaker integrated electronic device of FIG. 1, in which the outer housing has been removed to show a first and second speaker disposed within an inner housing.
Figure 3:
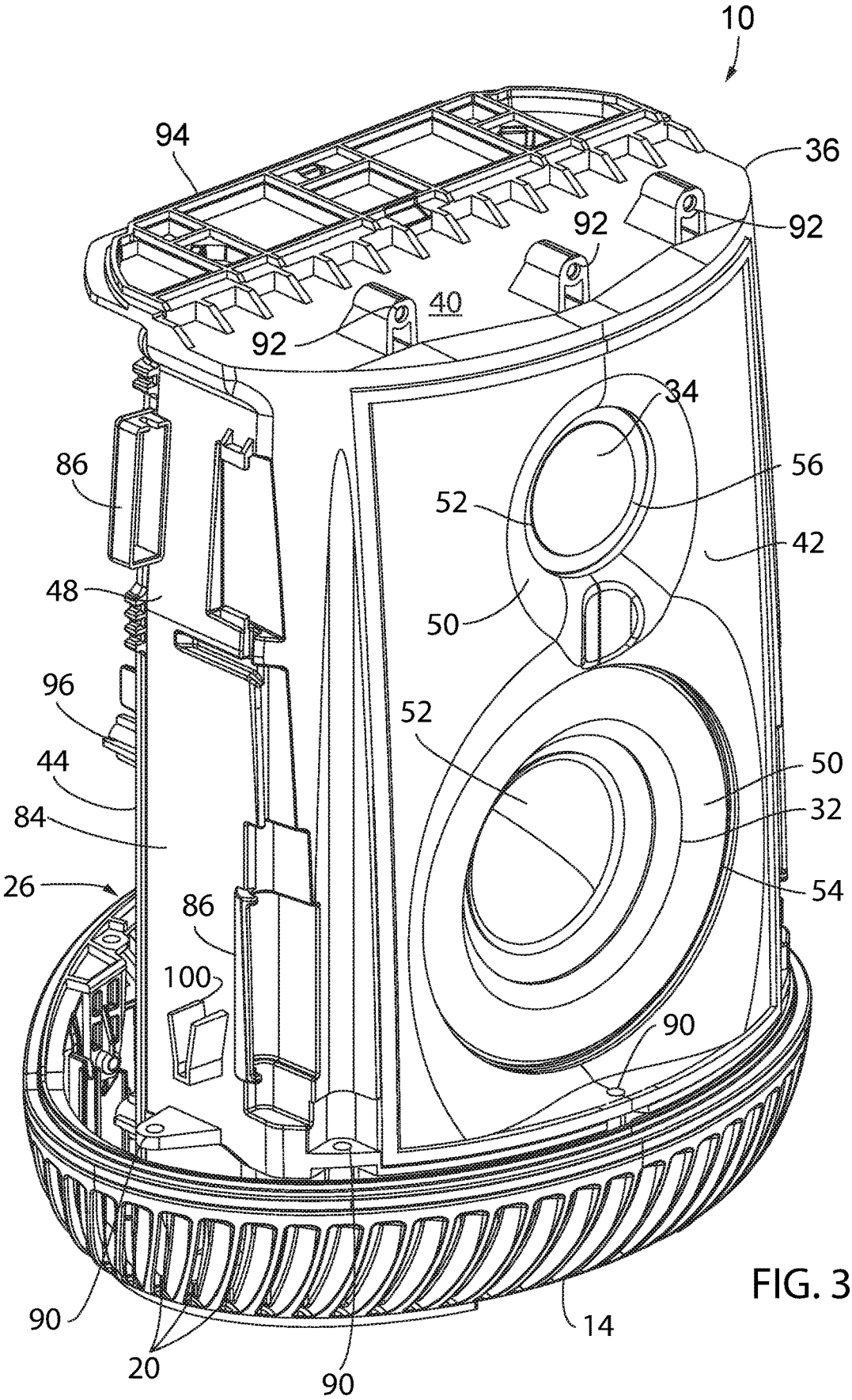
FIG. 3 is a front, upper and right-side isometric view of the speaker integrated electronic device of FIG. 1, in which the outer housing and internal electronic components have been removed.
Figure 4:
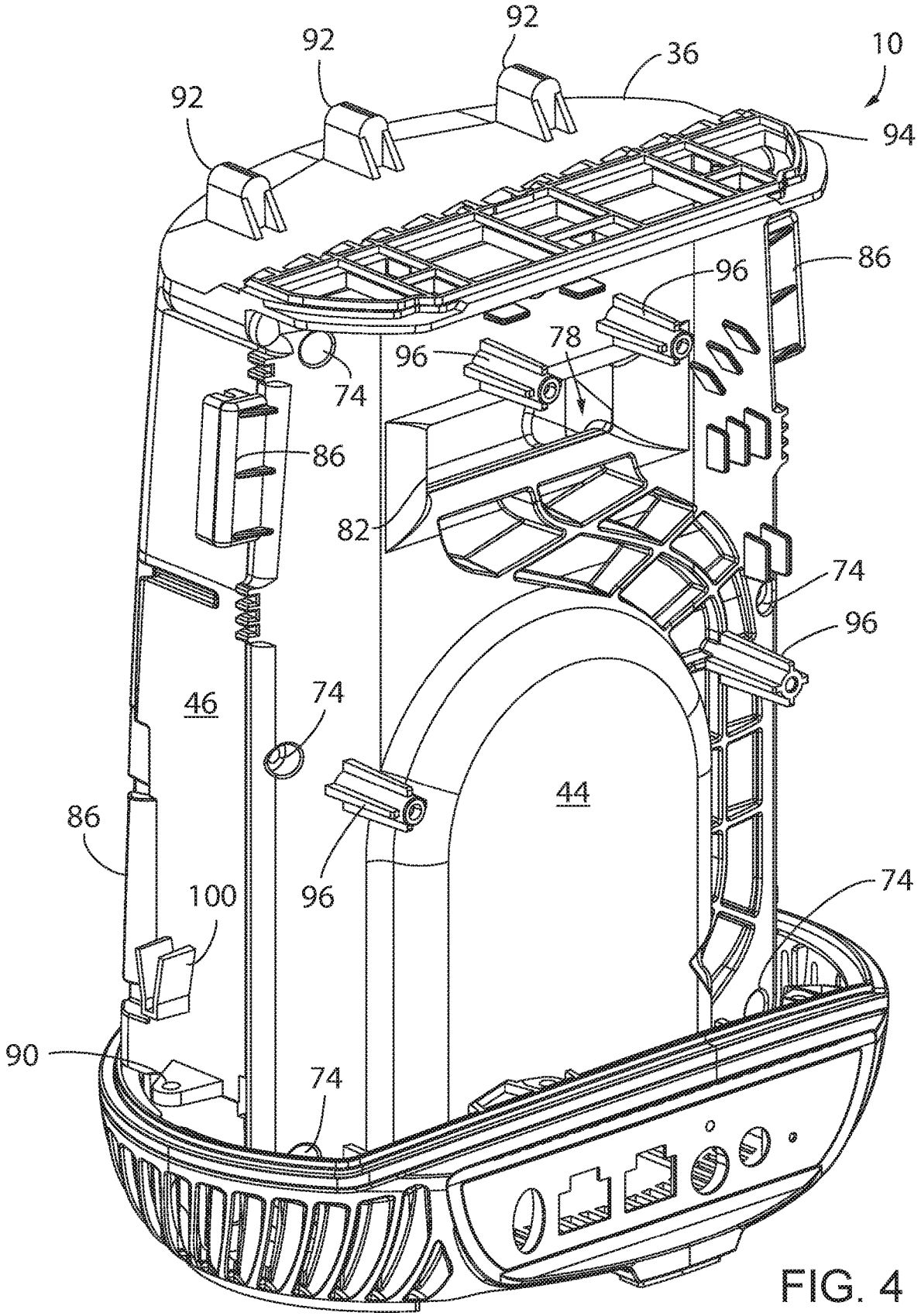
FIG. 4 a rear, upper and left-side isometric view of the speaker integrated electronic device as shown in FIG. 3.

Turning now to FIGS. 2-4, and initially FIG. 2 the electronic device 10 is shown without the sidewall 18 and top 16, thereby revealing the interior 26 of the electronic device 10. An inner housing 36 is located within the interior 26 of the electronic device 10 and includes a bottom 38 (not shown in FIG. 2), a top 40, a front 42, a rear 44, and opposing sides 46, 48. As shown in FIG. 2, the speakers 32, 34 are disposed within the front 42 of the inner housing 36, with the diaphragm cone 50 and dust cap 52 of each speaker 32, 34 extending through a corresponding generally circular void 54, 56 in the front 42 of the inner housing 36. It should be understood that while the illustrated embodiment of the electronic device 10 shown in FIG. 2 is a two-way speaker enclosure, e.g., includes two speakers 32, 34, which may correspond to a woofer of approximately 40 W and a tweeter of approximately 10 W, it should be understood that the present invention is not limited to such an embodiment or such speaker wattage. That is to say that electronic devices 10 including any number of 1 or more speakers of various power output are considered well within the scope of the present invention.

Figure 5:
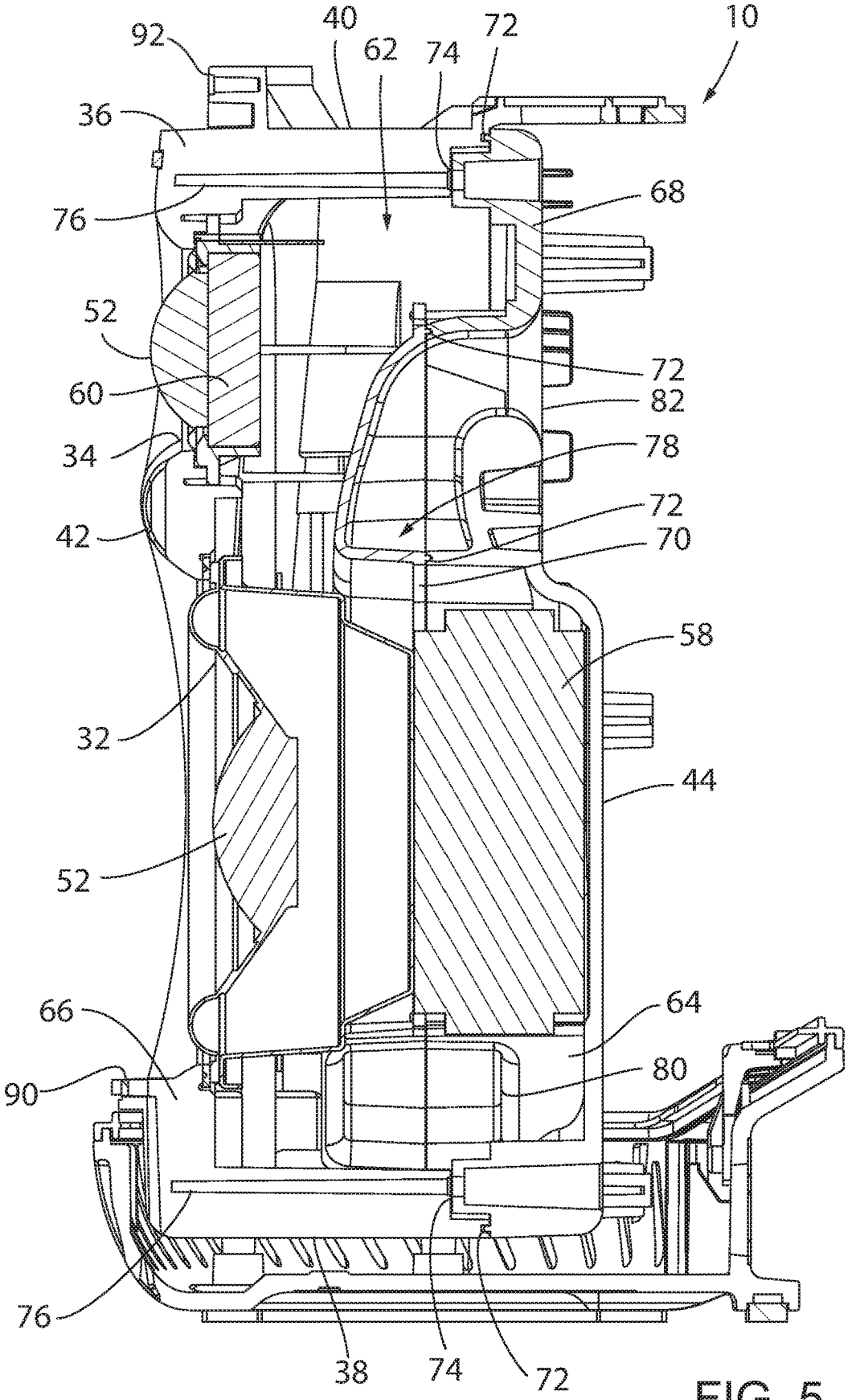
FIG. 5 is a longitudinal cross-sectional view of the speaker-integrated electronic device as shown in FIG. 3.

Referring briefly to FIG. 5, while the diaphragm cone 50 and dust cap 52 of each speaker 32, 34 extend through the front 42 of the inner housing 36, additional components of the speaker drivers 58, 60, including their magnet, pole piece and voice coil, are each located within the interior 62 of the inner housing 36 which defines a resonance chamber 64. In one embodiment of the invention, the resonance chamber 64 has a volume of between 0.75 and 1.25 liters and more preferably approximately 1.1 liters. The resonance chamber 64 will be described in further detail below.

To facilitate assembly of the inner housing 36, with the speaker drivers 58, 60 disposed within the resonance chamber 64 of the inner housing 36, in one embodiment of the present invention the inner housing 36 is formed of multiple molded plastic components. That is to say, that the inner housing 36 may include a first inner housing component 66 comprising in-part the front 42, a second inner housing component 68 comprising in-part the rear 44, and a third inner housing component 70, which may be disposed between the first component 64 and second component 66. However, it should be understood that the present invention is not limited to a three-component formed inner housing 36, and that a single unibody inner housing 36 or any number of components is considered well within the scope of the present invention.

Still referring to FIG. 5, one or more tongue and groove joints 72 positioned about the edges of the inner housing components 66, 68, 70 may facilitate for proper alignment of the first, second and third inner housing components 66, 68, 70 during assembly of the inner housing 36. Moreover, once they are properly aligned, with the speakers 30, 32 positioned therein, a fastener, such as a threaded fastener may extend through the fastener receiving slot 74 in the second inner housing component 68 and be received within a fastener seat 76 in the first inner housing component 66, thereby securely retaining the third inner housing component 70 sandwiched between the first and second components 66, 68. Once assembled, the interior 62 of the inner housing 36 forms both the resonance chamber 64 in which the speaker drivers 58, 60 are located, as well as an airflow channel 78 that is in fluid communication with the resonance chamber 64. The channel 78 includes an intake 80 located at the interior 62 of the inner housing 36 and an outlet 82 located at the rear 44 of the inner housing 36. As will be described in further detail below, the channel 78 provides a passage for air to passively move or flow from within the resonance chamber 64 in the interior 62 of the inner frame 36 to the outlet 82 that is located at the rear 44 of the inner housing 36.

Returning now to FIGS. 2-4, the outer surface 84 of the inner housing 36 includes a number of integrated or outwardly extending structures, which are preferably molded therein, including radio antenna sockets 86 that extend outwardly from the opposing sides 46, 48 of the outer surface 84. The radio antenna sockets 86 are configured to receive and retain antennas 88 therein for the transmission and reception of various WLAN related radio signals, including but not limited to Wi-Fi and Bluetooth. Additionally, various base mounts 90 may extend about the perimeter of the bottom 38 of the inner housing 36, which receive fasteners for securing the inner housing 36 to the base 14 of the electronic device 10. Similarly, a number of top mounts 92 may extend from the top 40 of the inner housing 36 and receive fasteners for securing the inner housing 36 to the top 16 of the electronic device 10. A support surface 94 may also extend upwardly from the outer surface 84 of the top 40 of the inner housing 36 that is configured to receive the top 16 of the outer housing 12 thereon during assembly. As shown in FIG. 2, the support surface 94 may be integrally molded to the first inner housing component 66 and extend generally rearwardly towards the rear 44 of the inner housing 36. Additionally, one or more circuit board mounts 96 may extend rearwardly from outer surface 84 of the rear 44 of the inner housing 36. The circuit board mounts 96 may be integrally molded with the second inner housing component 68 and be configured to receive a circuit board 98 or alternative electronic components thereon via a fastener such as a threaded fastener. As will be described in further detail below, the circuit board 98 is configured to be positioned adjacent the outlet 82 of the channel 78 when affixed to the circuit board mounts 96. Lastly, the outer surface 84 of the inner housing 36 may include at least one outer housing receiving slot 100 that is configured to engage with a portion of the outer housing 12 during assembly of the electronic device 10 and ensure proper alignment between the inner housing 36 and the outer housing 12. As shown in FIG. 2, one outer housing receiving slot 100 may extend outwardly from a side 46. A corresponding opposing outer housing receiving slot 100 also extends from opposing side 48 (not shown in FIG. 2). During assembly of the electronic device 10, a portion of the outer housing 12 may engage with the receiving slots 100 to facilitate proper positioning of the outer housing 12 about the inner housing 36.

Figure 6:
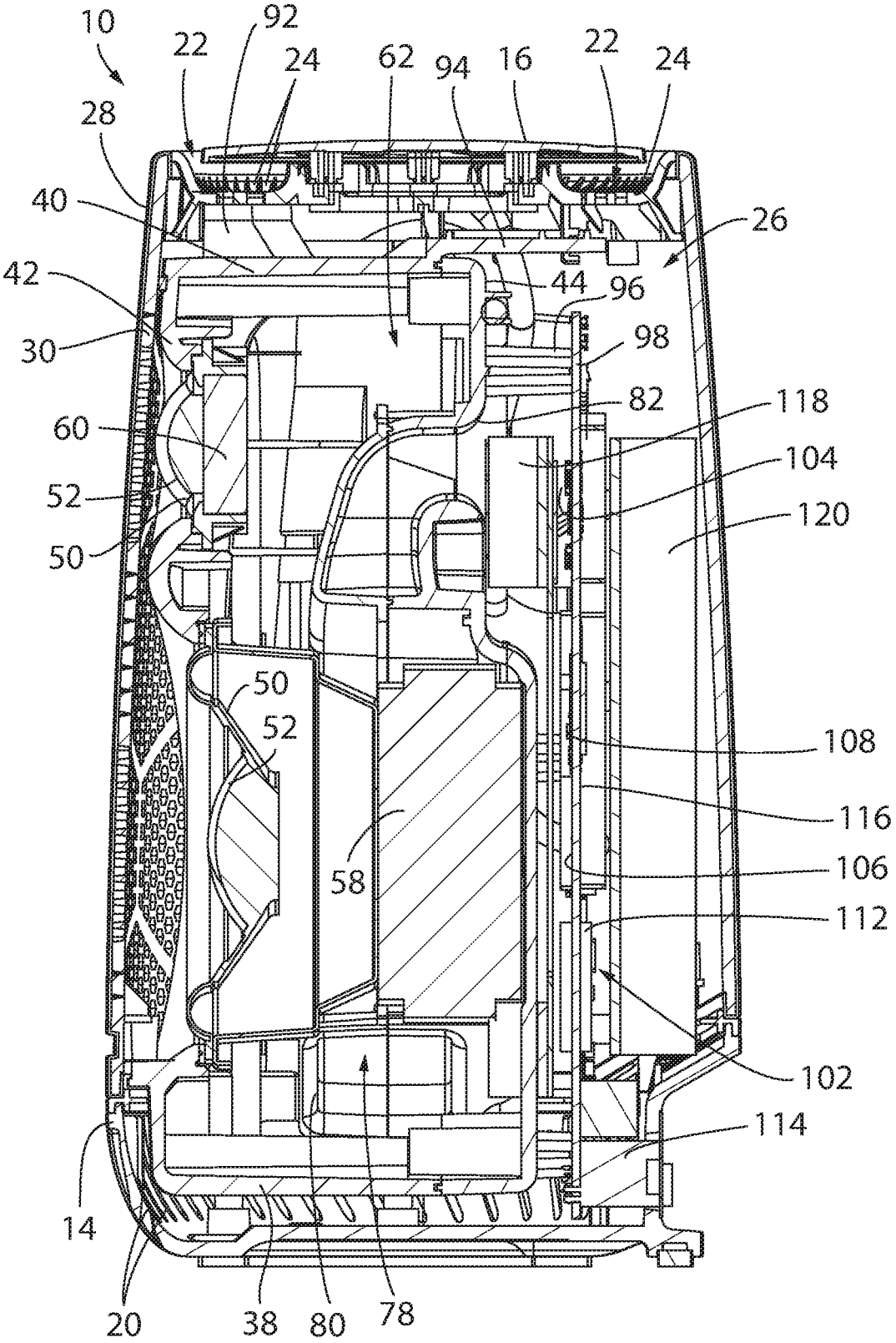
FIG. 6 is a longitudinal cross-sectional view of the speaker-integrated electronic device as shown in FIG. 1, including the outer housing and internal electronic components.
Figure 7:
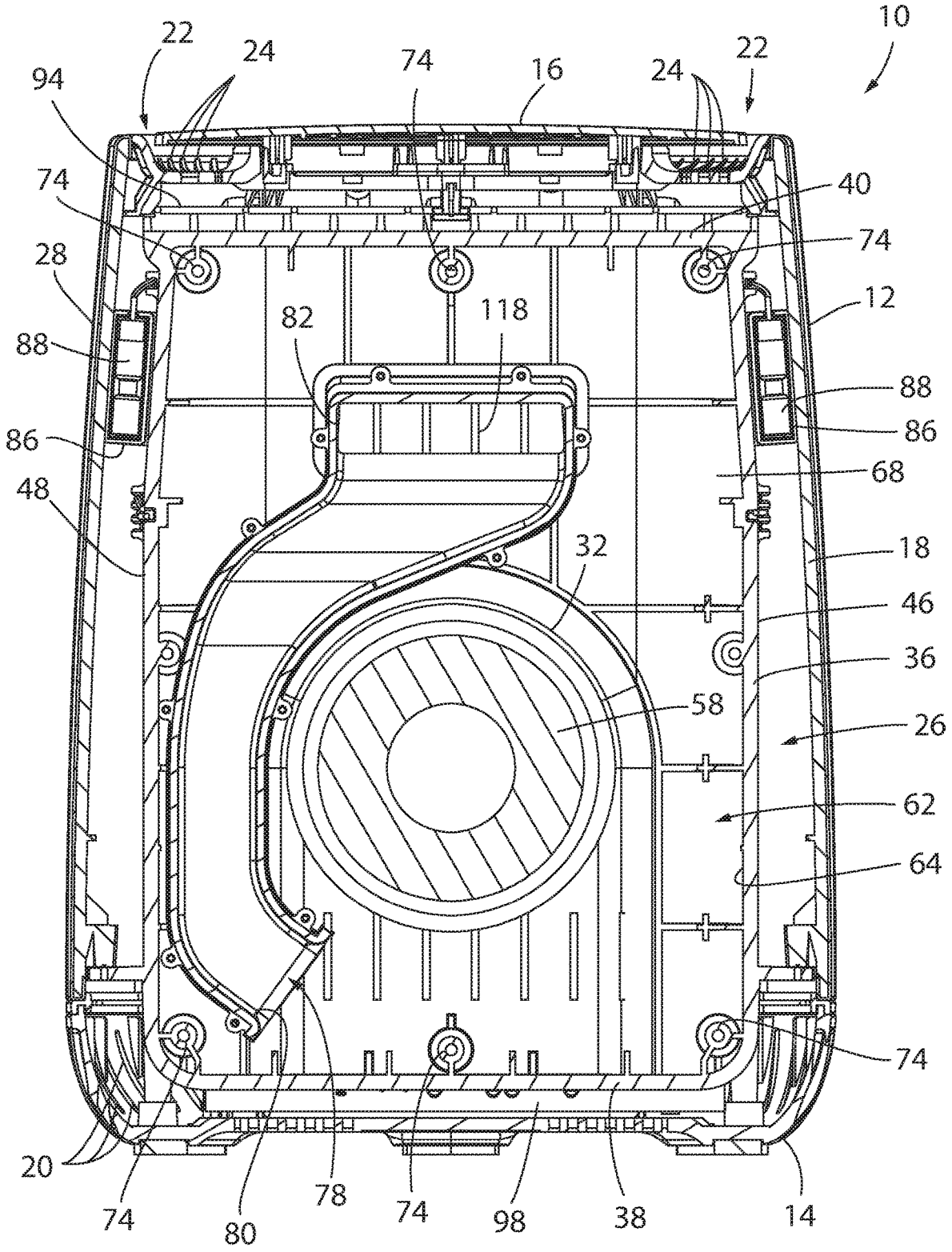
FIG. 7 is a coronal cross-sectional view of the speaker-integrated electronic device as shown in FIG. 6.

Turning now to FIGS. 6 and 7, the electronic device is shown in cross section. Referring initially to FIG. 6 the electronic device 10 as shown in one embodiment of the present invention combines the speakers 30, 32 with a wireless LAN access point, such as but not limited to a mesh Wi-Fi router, and a voice activated virtual assistance, commonly identified as a "smart speaker." The printed circuit board 98 includes the various electrical components 102 of the electronic device 10 integrated therein that are related to the smart speaker and Wi-Fi router aspects of the electronic device 10. By way of nonlimiting example, one or more Wi-Fi front end modules ("FEM") 104, may be located on a first side 106 of the circuit board 98, while, the central processing unit ("CPU") 108, memory 110, bus 112 and electrical connector ports 114 are located on an opposing second sides 116 of the circuit board 98. To facilitate the transfer of heat generated by the various electrical components 102 into the air located within the interior space 26, a first heat sink 118 may be disposed adjacent the first side 106 of the circuit board 98, and preferably adjacent to the Wi-Fi FEM 104, while a second heat sink 120 may be disposed adjacent the second side 116 of the circuit board 98. The first and second heat sinks 118, 120 are preferably formed of a cast or extruded metal or metal alloy having a relatively high thermal conductivity, such as copper or aluminum.

As shown in FIG. 6, the first heat sink 118 is positioned in the interior 26 of the outer housing 12, and adjacent the outlet 82 of the port 78, which is disposed within the rear 44 of the inner housing 36. As was previously mentioned, the channel 78 provides a passage for air to passively move or flow from within the resonance chamber 64 in the interior 62 of the inner housing 36 to the outlet 82 that is located at the rear 44 of the inner housing 36. Movement of the speaker cones 50, and particularly that of the relatively larger surface area cone 50 of the first speaker 30, which may be a woofer of approximately 40 W, results in the generation of sound waves, i.e., air movement, within the resonance chamber 64 of the inner housing 36. This moving air is them passed in-part into the channel 78, where it exits the outlet 82 at the rear 44 of the inner housing 36. In so doing, the air that exits the outlet 82 is directed over the surface of the first heat sink 118 directly and indirectly throughout the interior 26 of the outer housing 12. This increased passive airflow over the surface of the first heat sink 114 specifically, and through the interior 26 of the outer housing 12 generally, results in an improved heat transfer at the heat sinks 118, 120. That is to say, by passively increasing the flow of air through the interior 26 of the outer housing 12, without the use of a fan or pump, and specifically at the location of the first heat sink 118, the heat sinks 118, 120 exhibit an improved efficiency of transferring heat from the electrical components 102 into the surrounding air, and out of the electronic device 10 through the vents 20, 22. Resultantly, the electrical components 102 exhibit a decrease in operating temperature when air is passively passed through the channel 78 in accordance with one embodiment of the present invention, as compared to an operating temperature of in the absence of an air flow channel 78 in fluid communication with the resonance chamber 64 in the inner housing 36.

Still referring to FIGS. 6 and 7, the outlet 82 in one embodiment of the present invention has a width of approximately 15 to 30 millimeters, and more preferably 22 to 26 millimeters; a height of approximately 10 to 30 millimeters, and more preferably 18 to 22 millimeters; and, a length of approximately 125 to 175 millimeters, and more preferably 150 to 160 millimeters. The outlet 82 having the above described width, height and length emits an air flow having velocity of approximately 4 to 17 meters per second, and more preferably 6 to 14 meters per second, when air in the resonance chamber 64 is moved by the drivers 58, 60. That is to say that the outlet 82, having the above described width, height and length emits an air flow of preferably at or less than 17 meters per second, and more preferably between approximately 6 to 14 meters per second, as to minimize and/or eliminate, to the perception of an average listener, the undesirable audio distortion commonly referred to as "chuffing" that may result from air turbulence in the interior 62 of the inner housing 36. Such chuffing audio distortion may undesirably occur in the resonance chamber 64 if the perimeter, i.e., height and width, of the outlet 82 is increased relative to the length. Quantifiably, the electronic device 10, in accordance with the present invention, when subjected to a total harmonic distortion test as is generally known in the industry may exhibit a total harmonic distortion value of approximately less than 10% and more preferably approximately less than 4%; where the total harmonic distortion value is defined at the ratio of the equivalent root mean square voltage of all the harmonic frequencies over the root mean square voltage of the fundamental frequency, i.e., the main frequency of the signal output from the electronic device 10.

Moreover, the outlet 82, having the above described width, height and length, in combination with a resonance chamber of approximately 1.1, liters, emits an air flow of preferably between 6 and 14 meters per second as to maximize the increase the flow of air through the interior 26 of the outer housing 12, such that the heat sinks 118, 120 may exhibit an improved efficiency of transferring heat from the electrical components 102 into the surrounding air without resulting in chuffing audio distortion.

Temperature measurements of various electrical components 102 were collected during the process of identifying a width, height and length of the outlet 82 that maximizes heat transfer at the heat sinks 118, 120 and minimizes and/or eliminate chuffing audio distortion. During testing, a 2.4 GHZ 802.11ac Wi-Fi FEM 104 exhibited a reduction of approximately between 5.0° C. and 6.2° C. with passive cooling utilizing the above identified outlet 82 and resonance chamber 64, as compared to an electronic device 10 without such passive cooling. Similarly, a 5.0 GHZ 802.11a/n/ac Wi-Fi FEM 104 exhibited a reduction of approximately between 4.4° C. and 6.0° C. with passive cooling utilizing the above identified outlet 82 and resonance chamber 64, as compared to an electronic device 10 without such passive cooling. It should be understood that in one embodiment of the present invention, the electronic device 10 may include multiple Wi-Fi FEMs 104 located at the first side 106 of the circuit board 98, and below the first heat sink 118. For example, in one embodiment the electronic device 10 includes two (2) 2.4 GHZ 802.11ac Wi-Fi FEM 104 and four (4) 5.0 GHZ 802.11a/n/ac Wi-Fi FEM 104. Furthermore, during testing, additional electronic components 102, including but not limited to the CPU 108 and memory 110 exhibited a reduction of approximately between 4.0° C. and 6.0° C. with passive cooling utilizing the above identified outlet 82 and resonance chamber 64, as compared to an electronic device 10 without such passive cooling.

Turning now to FIG. 7, the interior 62 of the inner housing 36 is shown in cross section within the electronic device 10. As was previously described, the interior 62 of the inner housing 36 contains the speakers 30, 32. In addition to housing the speakers 30, 32, the interior 62 also defines a resonance chamber 64. That is to say that while primary sound waves generated by the speakers 30, 32 at the outer surface of the speaker diaphragms 50 are emitted from the device 10, secondary sound waves are generated by the speakers 30, 32 within the resonance chamber 64. These sound waves resonate, i.e., reverberate, within the resonance chamber 64 before being emitted from the device 10. Resultantly, the sound that is emitted from the electronic device 10 is enhanced by way of the resonance chamber 64, as compared to the sound output from the speakers 30, 32 absent a resonance chamber 64. More specifically, the electronic device 10, having a resonance chamber 64 exhibits an enhanced sound pressure level ("SPL") gain, and particularly in frequencies below approximately 300 Hz, as compared to the sound output from the speakers 30, 32 absent a resonance chamber 64.

Figure 8:
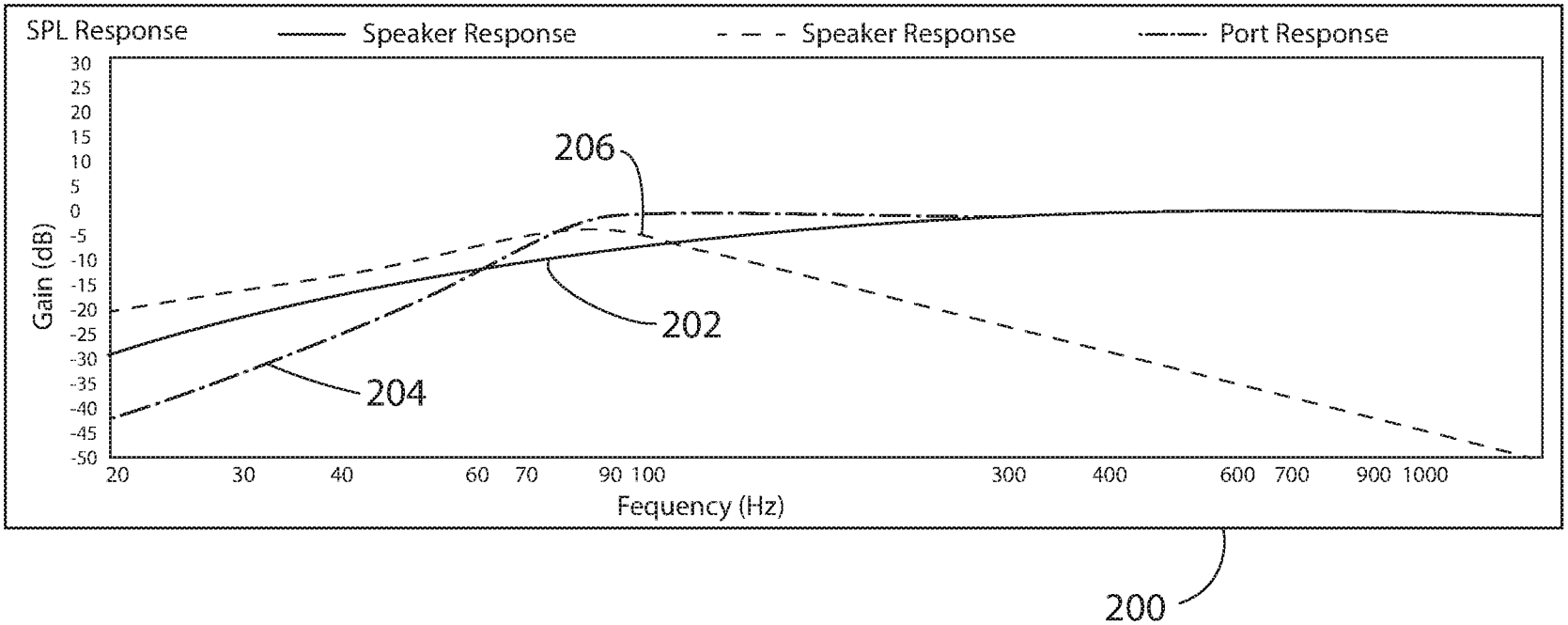
FIG. 8 is a chart showing the sound pressure level gain over a range of frequencies in both a control speaker that does not include a resonance chamber or air flow channel in accordance with the present invention, and an electronic device include both a resonance chamber and air flow channel in accordance with one embodiment of the present invention, as measured at both the speaker and the air flow channel outlet.

Turning now to FIG. 8, chart 200 is shown comparing the sound pressure level in decibels (dB) of a speaker 30 of the electronic device 10 at various frequencies in both a control setting, in which no resonance chamber 64 or air flow channel 78 is utilized, and in a trail setting, including use of a resonance chamber 64 and air flow channel 78 in accordance with the present invention. In chart 200, 0 dB indicates the maximum SPL output of the speaker 30, i.e., loudness, before the average listener would identify audio distortion in the sound output. Line 202 shows the sound pressure level in decibels of the speaker 30 in the control environment, without the use of the resonance chamber 64 or air flow channel 78 of the inner housing 36. Line 204 shows the sound pressure level in decibels of the speaker 30 in the trial setting measured at the speaker 30 in accordance with one embodiment of the present invention, i.e., utilizing the resonance chamber 64 and air flow channel 78 of the inner housing 36. Line 206 shows the sound pressure level in decibels of the speaker 30 also in the trial setting measured at the channel outlet 82 in accordance with one embodiment of the present invention, i.e., utilizing the resonance chamber 64 and air flow channel 78 of the inner housing 36.

Still referring to chart 200 in FIG. 8, it should be understood that the frequency range that corresponds to the bass signals in music, i.e., the bass range, is approximately 60 Hz to 200 Hz. Those signals that fall between 20 Hz and 60 Hz are often identified as the sub-bass range. With this understanding, chart 200 of FIG. 8 shows that the sound pressure level at the outlet 82, indicated by line 206, is greater than that of the control, shown by line 202, in the sub-base range. By way of non-limiting example, at a frequency of 40 Hz, the control produced an SPL of approximately between −20 and −15 dB, while utilizing the resonance chamber 64 and air flow channel 78 of the inner housing 36 in accordance with one embodiment of the present invention produced a SPL at the outlet 82 of approximately between −15 and −10 dB. That is to say, chart 200 of FIG. 8 shows that the use of the resonance chamber 64 and air flow channel 78 of the inner housing 36 results in increased SPL, i.e., loudness output from the electronic device 10, in the sub-base range as compared to the control. More specifically, chart 200 shows an increase of approximately between 5 and 10 dB at the sub-bass frequency of 40 Hz when utilizing the resonance chamber 64 and air flow channel 78 of the inner housing 36 according to the present invention.

Chart 200 of FIG. 8 further shows that the SPL at the speaker 30 as shown by line 204, in which the resonance chamber 64 and air flow channel 78 of the inner housing 36 are present, is greater than that of the control, shown by line 202, in the base range. Specifically, at a representative frequency of 90 Hz, the control produced a SPL of approximately between −10 and −5 dB, while the SPL of the speaker 30 in accordance with one embodiment of the present invention, including the use of the resonance chamber 64 and air flow channel 78 of the inner housing 36, exhibited a SPL of approximately between −5 and 0 dB. Resultantly, chart 200 of FIG. 8 shows that the use of the resonance chamber 64 and air flow channel 78 of the inner housing 36 results in increased SPL, i.e., loudness, in at least the bass range as compared to the control. More specifically, chart 200 shows an increase of approximately between 5 and 10 dB at the bass frequency of 90 Hz when utilizing the resonance chamber 64 and air flow channel 78 of the inner housing 36 according to the present invention. Resultantly, the load on the speaker amplifier, which is an electronic component 102 affixed to the circuit board 98, may be decreased during the output of frequencies in bass and sub-bass ranges from the electronic device 10, when the speakers 30, 32 are used the presence of the resonance chamber 64 in accordance with the present invention.

While the preceding discussion of increased SPL, i.e., loudness of the electronic device 10, resulting from the use of the resonance chamber 64 and air flow channel 78 of the inner housing 36 in accordance with the present invention has been described independently, it should be understood that this effect may be utilized in combination with the enhanced cooling benefit of the airflow channel 78, as previously described. That is to say, that activation of the diaphragm cone 50 of the speakers 30, 32, and particularly the relatively larger diaphragm cone 50 of speaker 30, when speaker 30 is a woofer of approximately 40 W, generates the movement of the air through the resonance chamber 64 and the airflow channel 78. Alternatively stated, the activation of the speaker 30 generates air flow through the channel 78, which exits the outlet 82 to improve airflow through the interior 26 and about heat sinks 118, 120 thereby exhibiting a reduction of the operating temperature of electrical component 102 by approximately between 4.0° C. and 6.0° C.

In addition to providing a source of air movement for use in passive cooling, i.e., cooling occurring absent the use of a dedicated fan or pump to circulate air, the presence of the resonance chamber 64 provides an additional benefit of decreasing the load on the speaker amplifier electrical component 102, when outputting low end frequencies of less than approximately 250 Hz from the electronic device 10. This decreased load on the speaker amplifier may result in a reduction of heat generated at the speaker amplifier electrical component 102.

Turning now briefly to FIGS. 9 to 12, an alternative embodiment of the electronic device 1010 is shown. It should be understood that in this alternative embodiment, similar structures correspond to those structures described in the preceding embodiment of the electronic device 10, and are identified by like numbers, to which "1000" have been added. That is to say, in FIGS. 9-12, like structures are identified by like reference numbers that have been increased by a value of 1000. A detailed description of these similar or common structures is not included below. However, it should be noted that the electronic device 1010 differs primarily in the form of the inner housing 1036, and its related air flow channel 1078.

Figure 9:
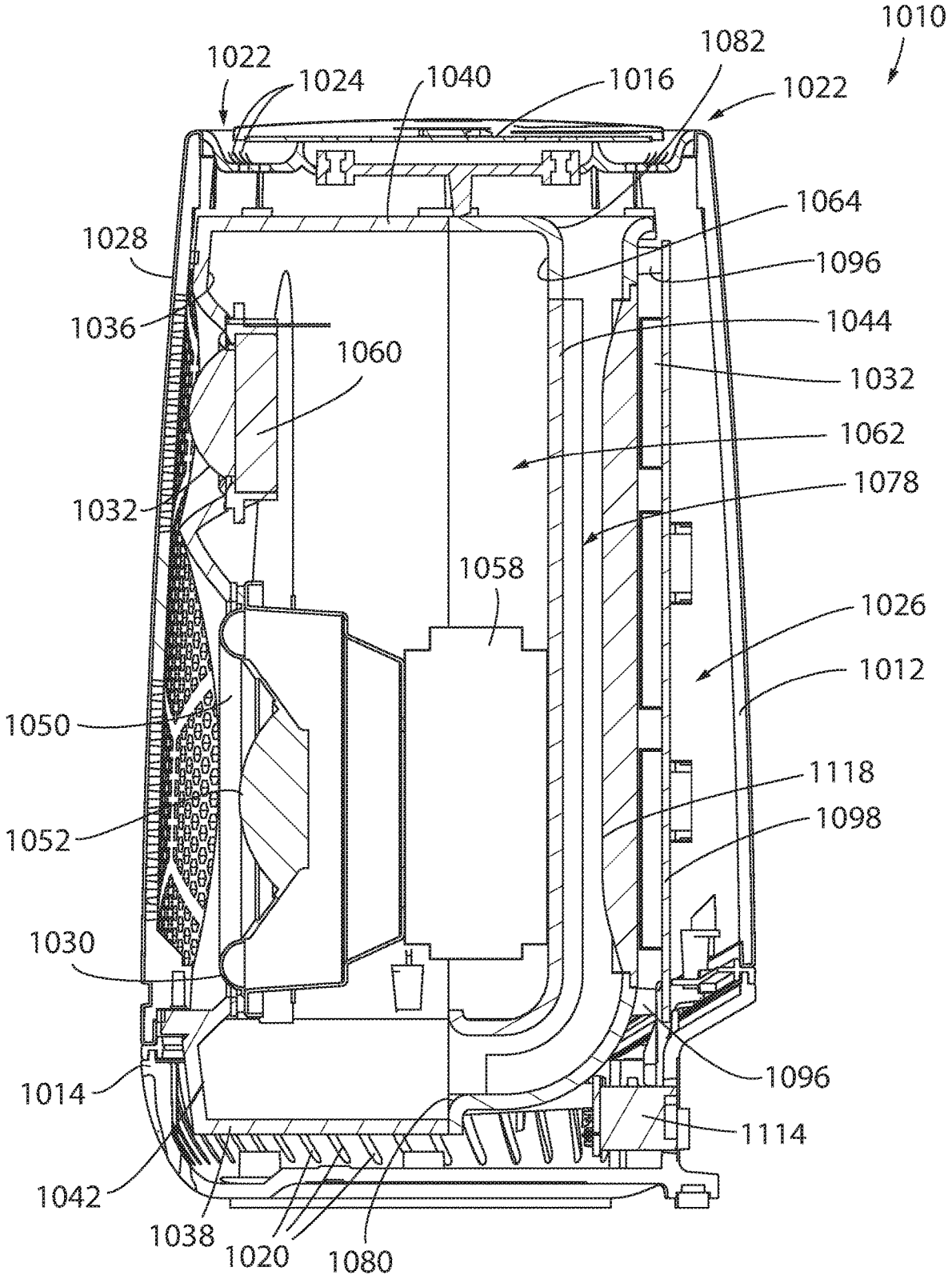
FIG. 9 is a longitudinal cross-sectional view of the speaker-integrated electronic device in accordance with an alternative embodiment of the present invention, including the outer housing and internal electronic components.
Figure 10:
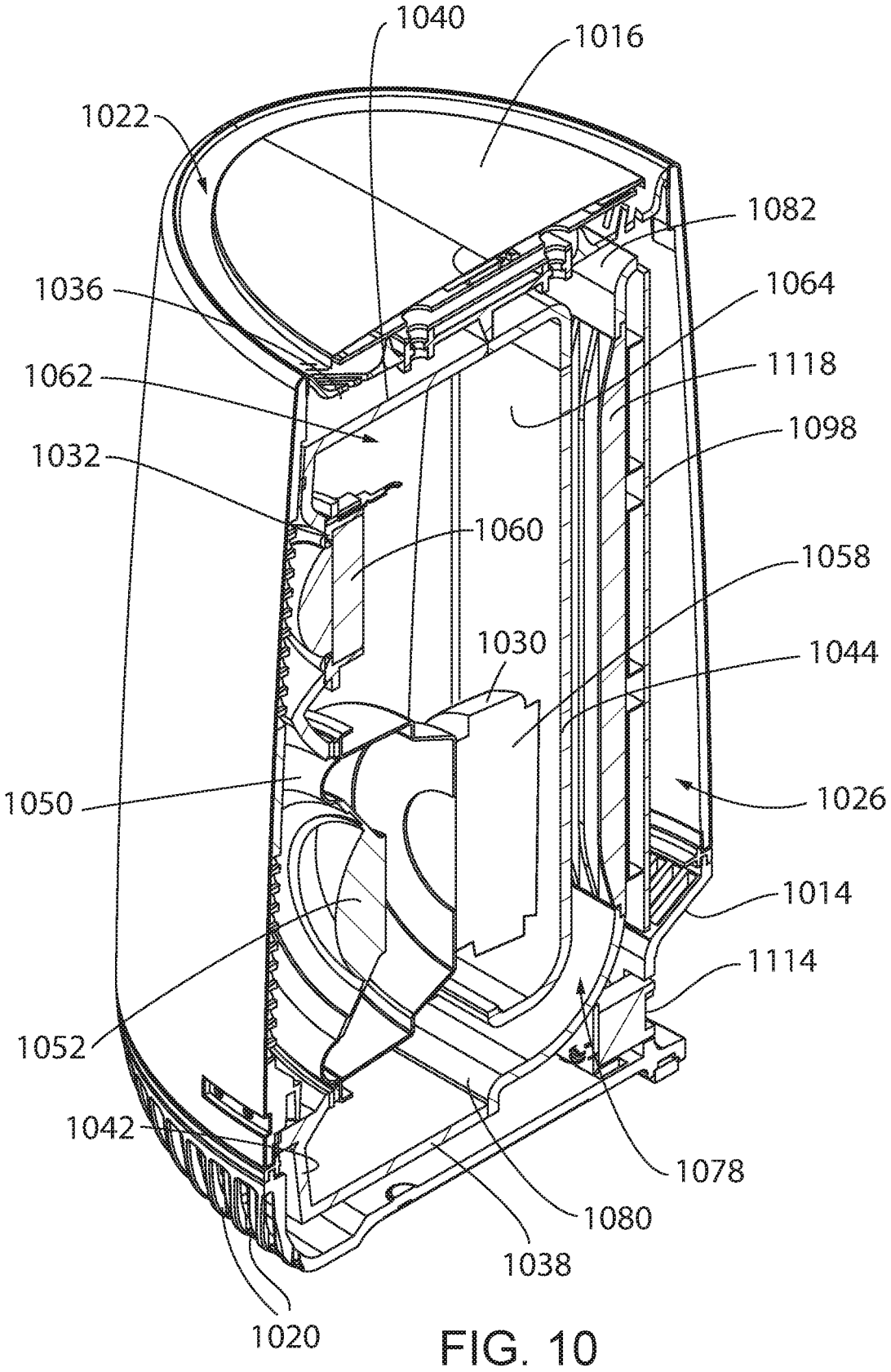
FIG. 10 is a perspective longitudinal cross-sectional view of the speaker-integrated electronic device of FIG. 9, including the outer housing and internal electronic components.
Figure 11:
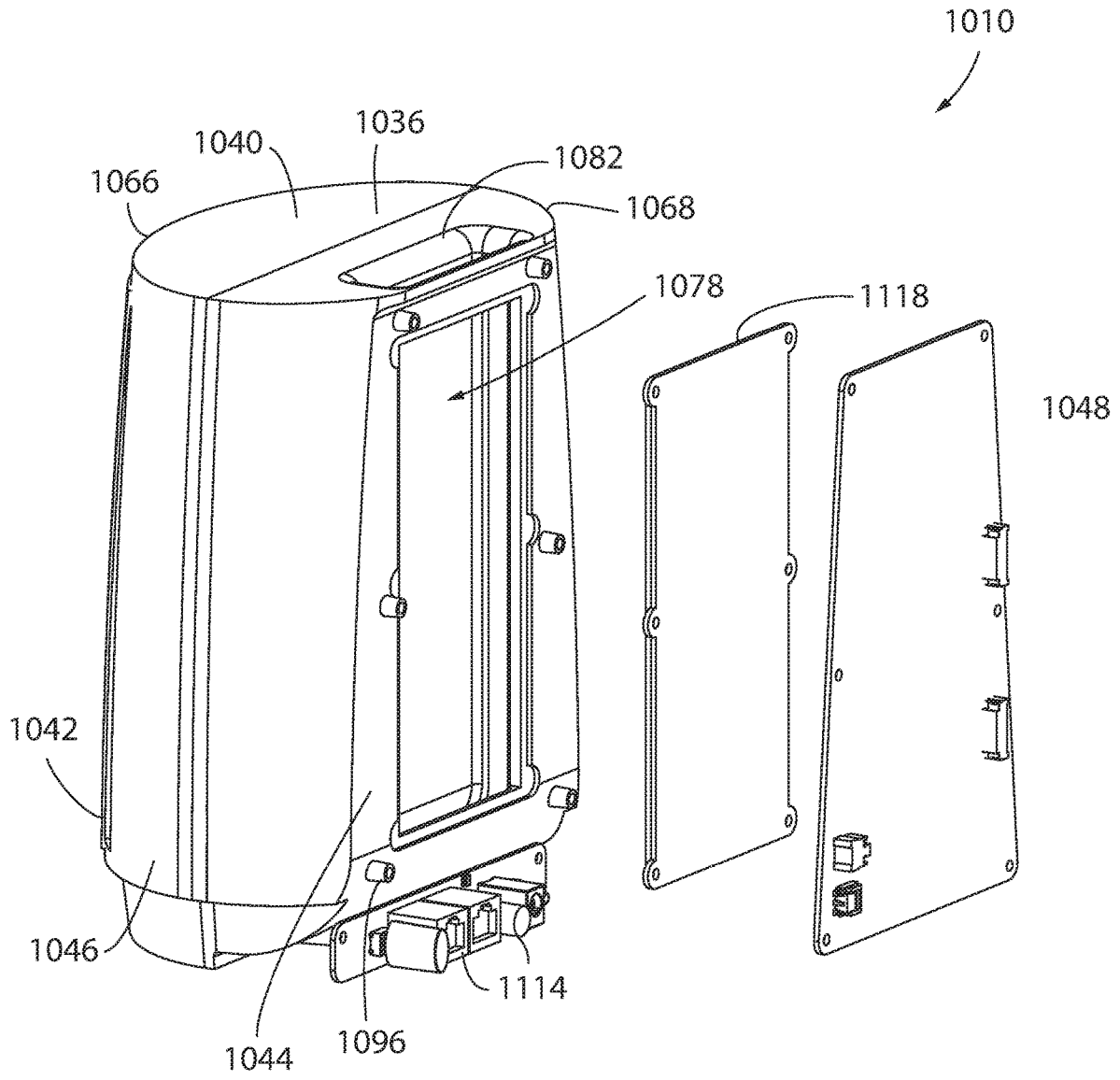
FIG. 11 is a partially exploded rear-perspective view of the longitudinal cross-sectional view of the speaker-integrated electronic device of FIG. 9, in which the outer housing has been removed to show an inner housing, heat sink and circuit board; and, FIG. 12 is a partially exploded front-perspective view of the longitudinal cross-sectional view of the speaker-integrated electronic device of FIG. 9, in which the outer housing has been removed to show a first and second speaker disposed within an inner housing, heat sink and circuit board.
Figure 12:
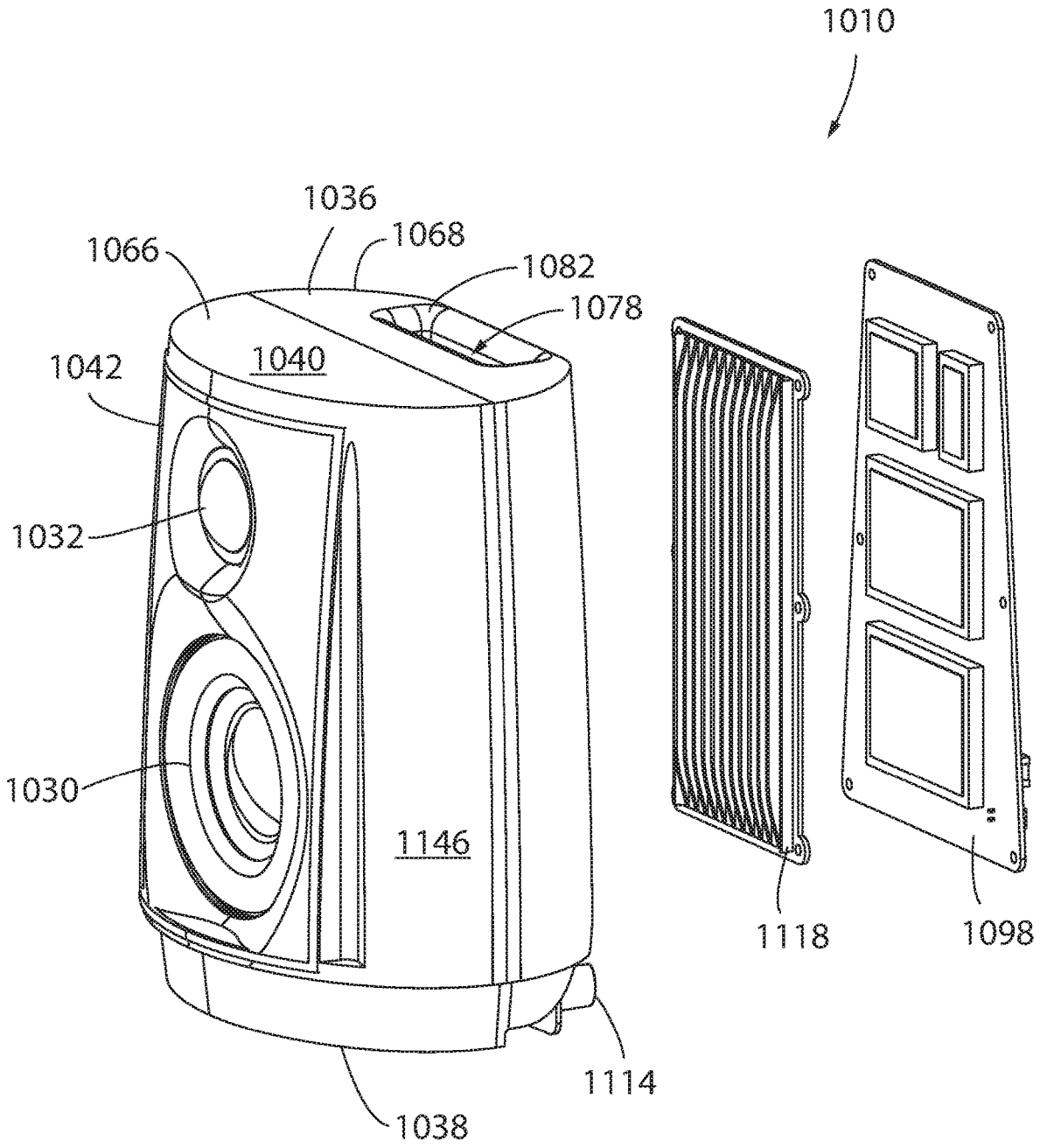

Referring now to FIGS. 9 and 10, the inner housing 1036 is shown located within the interior 1026 of the electronic device 1010 and includes a bottom 1038, a top 1040, a front 1042, a rear 1044, and opposing sides 1046, 1048. As shown in FIG. 9, the speakers 1032, 1034 are disposed within the front 1042 of the inner housing 1036, with the diaphragm cone 1050 and dust cap 1052 of each speaker 1032, 1034 extending through a corresponding generally circular void 1054, 1056 in the front 1042 of the inner housing 1036, while additional components of the speaker drivers 1058, 1060 are each located within the interior 1062 of the inner housing 1036 which defines a resonance chamber 1064. In one embodiment of the invention, the resonance chamber 1064 has a volume of between 0.75 and 1.25 liters.

The interior 1062 of the inner housing 1036 forms both the resonance chamber 1064 in which the speaker drivers 1058, 1060 are located, as well as an air flow channel 1078 that is in fluid communication with the resonance chamber 1064. The channel 1078 includes an intake 1080 located at the interior 1062 of the inner housing 1036 adjacent the bottom 1038 and an outlet 1082 located near the top 1040 of the inner housing 1036. Notably, the channel 1078 of electronic device 1010 is shown extending from the intake 1080 to the outlet 1082 outboard of the rear 1044 of the inner housing 1036. That is to say that one wall of the channel 1078 is formed by the outer surface 1084 of the rear 1044 of the inner housing 1036. In this configuration, the heat sink 1118 is positioned opposite the outer surface 1084 of the rear 1044 of the inner housing 1036, such that the heat sink 1118 forms the opposing wall of the channel 1078. This arraignment differs from the inner housing 36 of electronic device 10, in which the channel 78 was fully formed within the interior 62 of the inner housing 36, and air traveling through the channel 78 was only directed towards the heat sinks 118, 120 after exiting the outlet 82. In contrast, air moving through channel 1078 is allowed to pass over the fins of the heat sink 1118 over substantially the entire length of the channel 1078, e.g., from the inlet 1080 to the outlet 1082. Furthermore, the outlet 1082 is generally positioned within the top 1040 of the inner housing 1036, where it is positioned to vent heated air out of the interior 1026 of the electronic device 1010 through the vents 1026 in the top 1016 of the device. Again, this position of the outlet 1082 differs from that of outlet 82 in the previously described embodiment of the electronic device 10, in which the outlet 82 was located in the rear 44 of the inner housing 36 as to direct expelled air over the heat sinks 118, 120.

It is contemplated that an alternative embodiment may incorporate any of the features of the previous embodiments described above.

Many other changes and modifications could be made to the invention without departing from the spirit thereof.

What is claimed is:

1. A passively cooled speaker-integrated electronic device, comprising:

an exterior casing defining an interior;

an interior housing disposed within the interior of the exterior casing and having a wall defining a chamber within the interior housing, a void being formed in the wall of the interior housing;

a speaker disposed within the chamber and having a diaphragm located within the void in the wall of the interior housing;

an air flow channel having an inlet in fluid communication with the chamber and an outlet in fluid communication with the interior of the exterior casing; and, an electronic component located within the interior of the casing and being configured to receive a cooling air flow from the outlet that is passively generated in response to movement of the diaphragm as a result of speaker activation.

2. The electronic device of claim 1, wherein the electronic component has a first operating temperature in the absence of speaker activation and a second operating temperature when receiving air flow from the outlet in response to movement of the diaphragm during speaker activation, and wherein the second operating temperature is between 1° and 6° Celsius less than the first operating temperature.

3. The electronic device of claim 1, wherein the air flow at the outlet in response to movement of the diaphragm during speaker activation has a velocity of between 6 meters per second and 14 meters per second.

4. The electronic device of claim 3, wherein the chamber has a volume of between 0.75 and 1.25 liters.

5. The electronic device of claim 4, wherein the outlet of the air flow channel has a perimeter distance of between 245 and 410 millimeters.

6. A passively cooled speaker-integrated electronic device, comprising:

an exterior casing defining an interior;

an interior housing disposed within the interior of the exterior casing and having a wall defining a chamber within the interior housing, a void being formed in the wall of the interior housing;

a speaker disposed within the chamber and having a diaphragm located within the void in the wall of the interior housing;

an air flow channel having an inlet in fluid communication with the chamber and an outlet in fluid communication with the interior of the exterior casing; and, an electronic component located within the interior of the casing and being configured to receive a cooling air flow from the outlet that is passively generated in response to movement of the diaphragm as a result of speaker activation;

wherein the air flow at the outlet in response to movement of the diaphragm during speaker activation has a velocity of between 6 meters per second and 14 meters per second; and, wherein the velocity of the air flow at the outlet generates a total harmonic distortion value of less than 10% during speaker activation, and wherein the total harmonic distortion value is a ratio of the equivalent root mean square voltage of all the harmonic frequencies output from the device during speaker activation over the root mean square voltage of the signal output from the speaker of the electronic device.

7. The electronic device of claim 1, further comprising a heat sink affixed to the electronic component, wherein the heat sink is disposed within the interior of the casing between the electronic component and the outlet.

8. The electronic device of claim 1, wherein the electronic device is a WLAN router, and the electronic component comprises at least one Wi-Fi front end module.

9. The electronic device of claim 8, wherein the electronic device further comprises a voice-activated virtual assistant.

10. The electronic device of claim 1, wherein the chamber further defines a resonance chamber that is configured to increase a sound pressure level output from the electronic device during speaker activation.

11. The electronic device of claim 10, wherein the sound pressure level output from the electronic device during speaker activation increases between 1 to 10 dB when the speaker is outputting a sound having a frequency of between 20 Hz and 60 Hz.

12. The electronic device of claim 10, wherein the sound pressure level output from the electronic device during speaker activation increases between 1 to 10 dB when outputting a sound having a frequency of between 60 Hz and 250 Hz.

13. A passively cooled speaker-integrated wireless router, comprising:

an outer housing defining an interior therein;

an inner housing disposed within the interior of the outer housing and having a wall defining a resonance chamber;

at least one speaker disposed within the resonance chamber and having a diaphragm that extends through at least one corresponding void in the wall of the inner housing;

an air flow channel that is located in the inner housing and that has an inlet in fluid communication with the resonance chamber and an outlet in fluid communication with the interior of the outer housing, an electronic component that is located within the interior of the outer housing and that is configured to receive air flow from the outlet that is generated in response to movement of the diaphragm as a result of speaker activation, wherein the air flow at the outlet in response to movement of the diaphragm during speaker activation has a velocity of between 6 meters per second and 14 meters per second.

14. The speaker integrated wireless router of claim 13, further comprising a heat sink affixed to the electronic component, wherein the heat sink is disposed within the interior of the casing between the electronic component and the outlet.

15. The speaker integrated wireless router of claim 13, wherein the inner housing comprises a first inner housing component including a first surface, the first surface including therein the least one void for receiving the diaphragm of at least one speaker, and, a second housing component that is configured to releasably engage the first inner housing component, the second housing component including the air flow outlet therein.

16. The speaker integrated wireless router of claim 13, further comprising a woofer speaker and a tweeter speaker, wherein the woofer speaker is located between the tweeter speaker and the inlet of the air flow channel.

17. A method of passively cooling a speaker integrated electronic device, the electronic device comprising a casing defining an interior, a housing disposed within the interior of the casing and having an outer wall defining a housing interior, a speaker driver disposed within the housing interior and having a diaphragm that extends outwardly from the driver through a void in the outer wall of the housing, an air flow channel having an inlet in fluid communication with the housing interior to an outlet in fluid communication with the interior of the casing, an electronic component located within the interior of the casing, the method comprising:

providing an electrical signal to the speaker driver to active the diaphragm to move so as to push air within housing interior and create an air flow;

directing the air flow from the inlet of the air flow channel to the outlet;

expelling the air flow from the outlet of the airflow channel and into the interior of the casing at a velocity of less than 14 meters per second; and decreasing an operating temperature of the electronic component between 1° and 6° Celsius as a result of the air flow into the interior of the casing.

18. The method of claim 17, wherein the step of moving the diaphragm to push air within housing interior and create an air flow generates a sound wave having a frequency and a primary output at an outer surface of the diaphragm, and further comprising the step of:

reverberating the sound wave within the housing interior to generate a secondary output from the speaker integrated electronic device, wherein the secondary output has a sound pressure level output of between 1 to 10 dB when the frequency of the sound wave is between 20 Hz and 250 Hz.

19. The method of claim 17, wherein the air flow at the outlet of the air flow channel in response to movement of the diaphragm during speaker activation has a velocity of between 6 meters per second and 14 meters per second.

20. The method of claim 19, wherein the electronic component comprises at least one Wi-Fi front end module, and the method further comprises the step of transmitting a WLAN signal from the Wi-Fi front end module while decreasing an operating temperature of the Wi-Fi front end module between 1° and 6° Celsius as a result of receiving air flow at the outer surface of the heat sink that is generated in response to movement of the diaphragm as a result of speaker activation.

* * * * *